US005823885A

United States Patent [19]

Stempfer

[11] Patent Number: 5,823,885

[45] Date of Patent: Oct. 20, 1998

[54] PORTABLE PERSONAL DRIVING RANGE AND ALL PURPOSE SPORTING NET

[76] Inventor: Frank N. Stempfer, 5351 Hamlin St., Murray, Utah 84123

[21] Appl. No.: 756,008

[22] Filed: Nov. 25, 1996

[51] Int. Cl.[6] ..... A63B 69/36

[52] U.S. Cl. ..... 473/197; 473/421; 473/166; 473/192; 273/400

[58] Field of Search ..... 473/153, 168, 473/166, 164, 195, 197, 172, 190, 421, 462; 273/400, 402, 406

[56] References Cited

U.S. PATENT DOCUMENTS

| | | | |
|---|---|---|---|
| 1,656,718 | 1/1928 | Bickford | 473/164 |
| 1,745,201 | 1/1930 | Alston | 473/195 |
| 1,788,803 | 1/1931 | MacGeorge | 473/172 |
| 1,857,059 | 5/1932 | Matheson et al. | 473/192 |
| 2,043,273 | 6/1936 | Watson | 473/195 |
| 2,123,195 | 7/1938 | Middleton | 473/195 |
| 2,375,904 | 5/1945 | Elkins | 473/190 |
| 3,260,527 | 7/1966 | Younce | 473/166 |
| 4,905,996 | 3/1990 | Tallent et al. | 473/197 |
| 5,018,731 | 5/1991 | Doyle | 473/166 |
| 5,269,527 | 12/1993 | Noval | 473/197 |
| 5,586,942 | 12/1996 | Wittek, Sr. et al. | 473/168 |

*Primary Examiner*—Mark S. Graham
*Attorney, Agent, or Firm*—Workman, Nydegger, and Seeley

[57] ABSTRACT

A portable personal sporting net includes a tapered cylindrical or funnel-like tubular, pliable, porous net having an enlarged entrance aperture which is supported by a collapsible pole. In one embodiment, a suspended exit aperture is formed at the opposing end of the netting. A ball capture bag communicates with the exit aperture to catch balls hit into the netting. In an alternative embodiment, the opposing second end of the netting is closed against the ground surface. A pair of flaps are mounted on opposing sides of the entrance aperture and radially extend forward and outward therefrom. The flaps assist in directing stray balls into the funnel-like netting.

20 Claims, 4 Drawing Sheets

PORTABLE PERSONAL DRIVING RANGE AND ALL PURPOSE SPORTING NET

BACKGROUND OF THE INVENTION

1. The Field of the Invention

This invention relates to sports training and practice equipment, and in particular to an easily disassembled portable kit providing personal practice and training capability almost anywhere without inconvenience or hazard to nearby others.

2. Background of the Invention

Many golf players would like to have the opportunity for more frequent practice in developing a proper stroke. Since hitting a golf ball generally results in the golf ball traveling an extended distance, golfers are generally required to travel to a golf range to practice their stroke. The necessary use of an established golf range or golf course, however, is often inconvenient for reasons such as the time required to get there, delays due to increased overcrowding, and the cost of using the facility.

An additional problems with golf ranges is that they cannot be used in bad weather or in the winter. Some attempts have been made to develop indoor golf ranges. Such ranges, however, require expansive buildings. Furthermore, although large nets have been used to help limit the distance the ball may travel, some net structures are dangerous in that they result in the golf ball bouncing back at the person striking the ball.

The same general problems are also found by other athletes who want to independently practice with a ball but do not have the room to do so. For example, soccer players, football kickers, and baseball players are also limited by available area to practice their desired sport.

OBJECTS AND BRIEF SUMMARY OF THE INVENTION

Accordingly, it is an object of the present invention to provide portable personal sporting nets.

Another object of the present invention is to provide personal sporting nets that can be used either indoors or outdoors.

Also another object of the present invention is to provide personal sporting nets that are easily transported, assembled, and disassembled by a single individual.

Another object of the present invention is to provide personal sporting nets that can be assembled and used in relatively small areas, such as in a persons backyard.

Yet another object of the present invention is to provide personal sporting nets that confine the distance that a golf ball will travel after being hit.

Still another object of the present invention is to provide personal sporting nets that capture the golf ball, thereby preventing the golf ball from bouncing back and striking the golfer.

Finally, anther object of the present invention is to provide personal sporting nets that can be used with a variety of sports for confining the distance a ball, such as a baseball, football, or soccer ball will travel.

Other objects, features, and advantages will become apparent from a consideration of the following detailed description and from the accompanying drawings.

To achieve the foregoing objects, and in accordance with the invention as embodied and broadly described herein, a personal sporting net which can function in one use as a driving range is provided. In one embodiment, the personal sporting net comprises a substantially funnel-shaped netting having a first end with an enlarged entrance aperture formed thereat and selectively positioned on a ground surface. The personal sporting net also includes an opposing second end having a smaller exit aperture extending therethrough and being elevated off the ground surface. A capture bag is secured over the exit aperture. Accordingly, as a ball is struck, the ball enters the entrance aperture, travels along the funnel netting, and passes through exit aperture where the ball is captured by the capture bag.

In an alternative embodiment, the personal sporting net comprises a semi-conical backstop that is mounted on a ground surface. The backstop has an enlarged access opening that provides access to an enclosed receiving chamber. A pole is secured to the front end of the backstop to maintain the access opening in an upstanding position. In one embodiment, a floor is secured to the backstop. In an alternative embodiment, a connecting strap extends between the ends of the poles to maintain the pole in an arched position.

Radially extending out and forward from opposing sides of the access opening are a pair of flaps. The flaps help to capture and guide balls into the receiving chamber.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
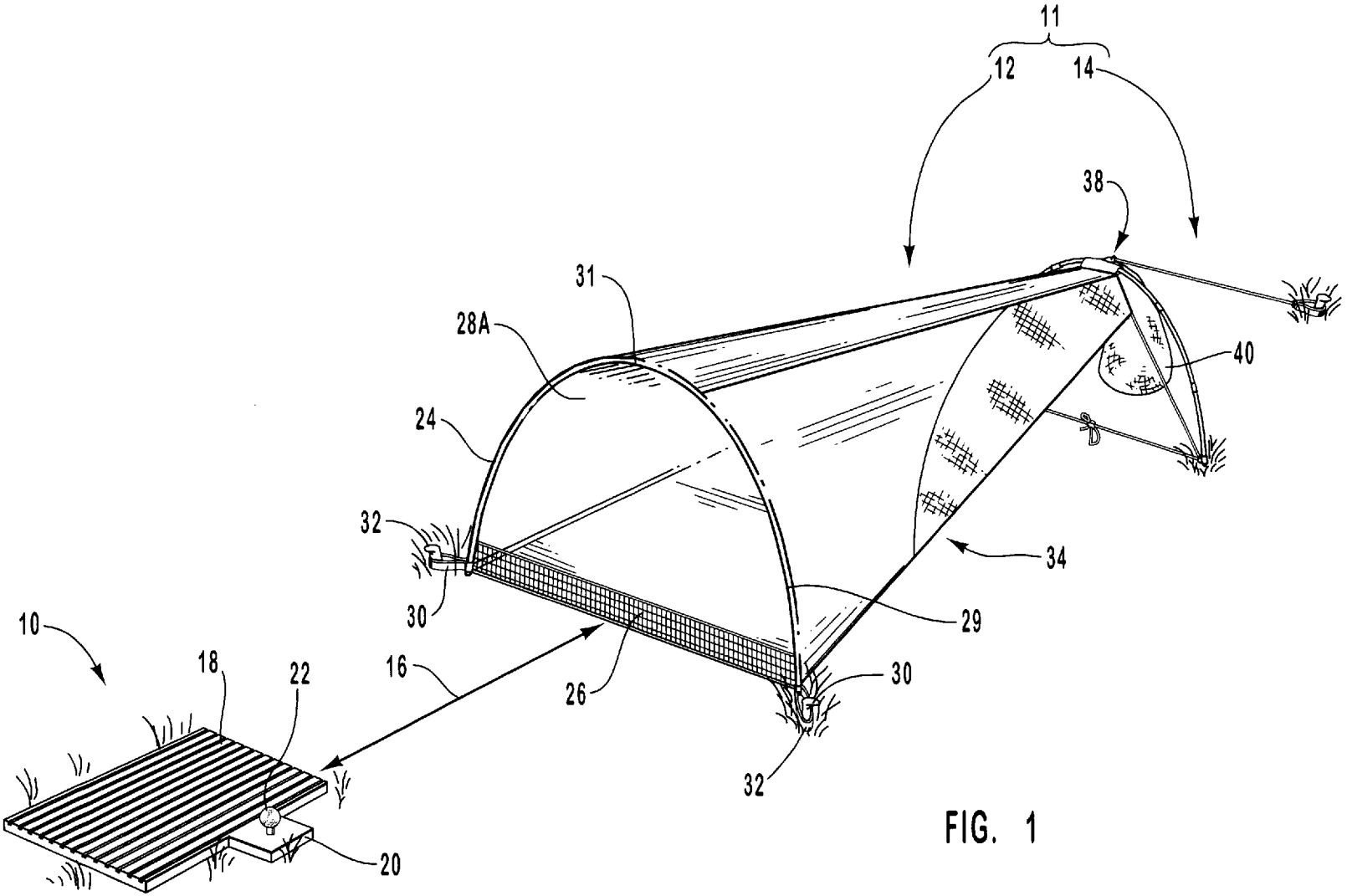
FIG. 1 is a perspective view of an assembled personal sporting net providing a view of the entrance to the personal sporting net and the platform on which the user stands and the adjacent auxiliary platform upon which the ball is emplaced.

Referring more particularly to the drawings, FIG. 1 shows a user platform 10 for use with one embodiment of a personal sporting net 11 incorporating features of the present invention. Personal sporting net 11 comprises a main assembly 12 and a rear assembly 14.

In one presently preferred embodiment of the present invention, platform 10 comprises a textured, flexible, nonslip user mat or pad 18, made for example of natural or synthetic ribbed rubber or similar organic material. Adjacent the right front end of user mat 18, there is provided a ball mat 20, likewise of rubber in the preferred embodiment. A golf tee and ball 22 are placed upon ball mat 20. In one embodiment, ball mat 20 is an integral part of the user mat 18. In an alternative embodiment, ball mat 20 can be detached from user mat 18 for separate emplacement. In another embodiment, personal sporting net 11 can be used without platform 10 by simply placing the ball on the ground.

Main assembly 12 comprises a converging tubular funnel of netting 34. In the preferred embodiment, the shape of the funnel is that of the truncated frustum of a cone. Netting 34 can be made of cloth or any other similar porous material, such as a pliant synthetic fabric. One open end of the frustum is designated as entrance aperture 28A. Entrance aperture 28A is located at the front end of the main assembly 12 so as to face the user on pad 10.

Entrance aperture 28A is defined by a supporting arch 29. Supporting arch 29 is formed by inserting an elongated, flexible tent pole 24 within a sleeve 31. In one embodiment, tent pole 24 comprises a multicomponent, collapsible pole in which the discrete elements of the pole are held together by a shock cord. In alternative embodiments, tent pole 24 can comprise separate poles that are connected together at opposing ends.

The entrance arch is secured by a bracing leg 30 on its left and right sides. Each such bracing leg 30 is in turn secured by its own attachment means 32, which may be, for example, when outdoors a tent-stake, and when indoors a weight.

The smaller rear end of the frustum defines an exit aperture 28B. Because of the tapering diameter of the cone-segment defining the frustum, balls whose trajectory is not directly toward exit aperture 28B are reflected from the sides of the frustum to focus on exit aperture 28B. This reflection reduces the transverse component of the ball's momentum, but only slightly reduces its forward momentum. Accordingly, unless the momentum of the ball is very small, the ball must pass through the exit aperture 28B.

Located at the bottom of aperture 28A is an optional front capture net 26. Front capture net functions to prevent balls which have not passed through the exit aperture 28B from rolling back out of main assembly 12.

Use of the invention requires the user to select a distance 16 between the user and entrance aperture 28A. The user should be sufficiently far from the front of the main assembly 12 that no reasonably likely stroke will allow the user's club to hit the main assembly 12, and yet sufficiently close to entrance aperture 28A that no reasonably likely trajectory of the ball will permit it to escape from entering this aperture. In one presently preferred embodiment of the principles disclosed herein, the entrance aperture 28A is about five feet high and about five feet wide, and the selected distance 16 is about three or four feet. However, different users have the option of adjusting this distance at will.

In another embodiment, entrance aperture 28A can be configured so that the top thereof slants backward away from the user. The positioning allows increased space to prevent the user from striking pole 24 without significantly reducing the ability of entrance aperture 28 to capture the ball.

Figure 2:
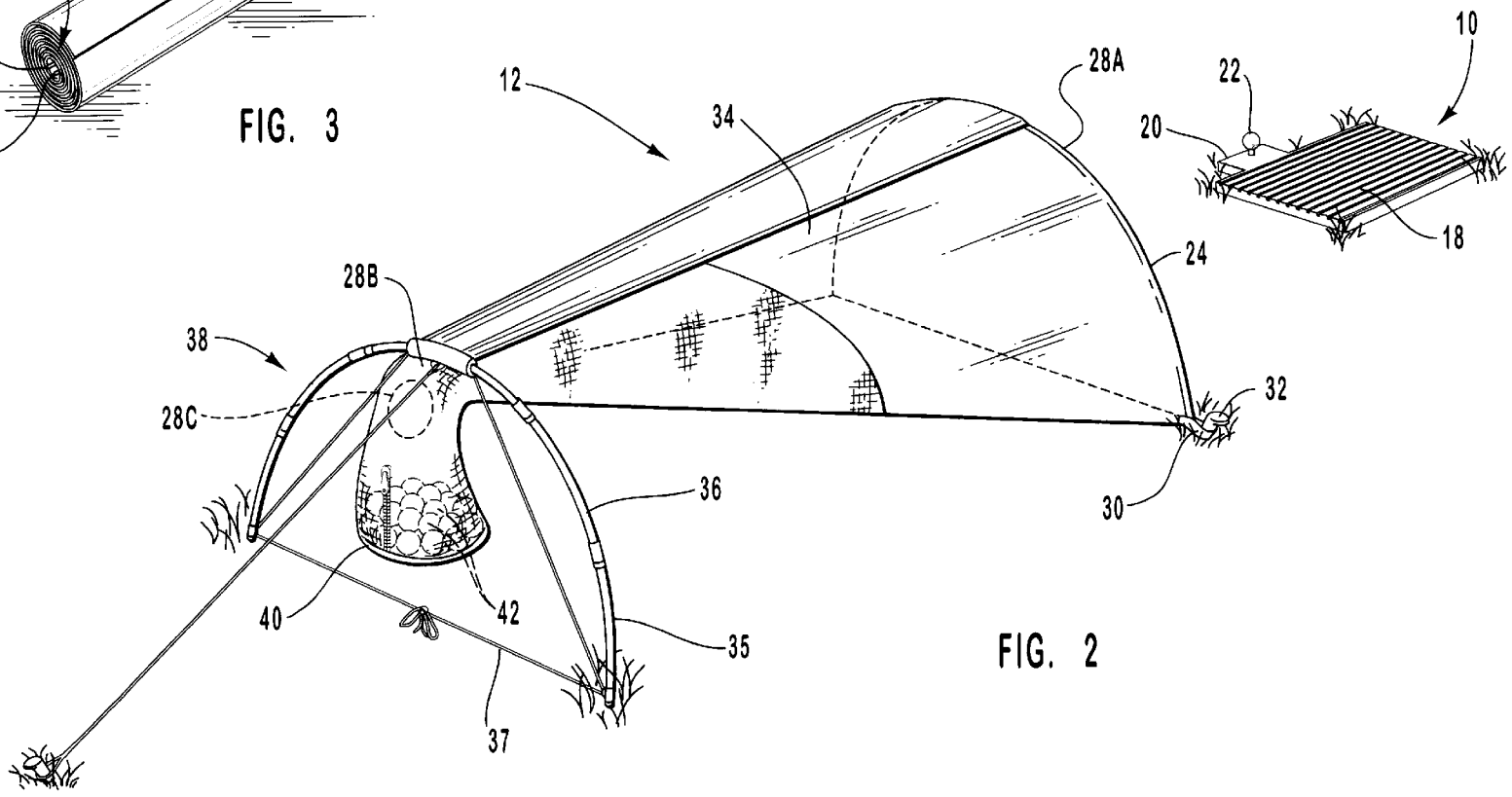
FIG. 2 is a perspective rear view of the personal sporting net shown in FIG. 1.

Referring now to FIG. 2, the rear end of main assembly 12 is suspended from a support arch 35 defined by a pole 36. Pole 36 can be configured substantially the same as pole 24 previously discussed. Pole 36 is maintained in an arched configuration by a cord 37 extending between the opposing ends thereof.

Fitted snugly over exit aperture 28B and suspended pendulously from it is a capture bag 40. Capture bag 40 captures used balls 42 passing through exit aperture 28B and striking the side of capture bag 40.

In an alternative embodiment of the invention, exit aperture 28B is blocked by a resilient solid disk 28C. Solid disk 28C absorbs most of the forward momentum of the ball, essentially nullifying its tendency to bounce, and allowing the ball to fall straight downward into capture bag 40 under the influence of gravity alone.

In still another alternative embodiment of the invention, disk 28C is equipped with electronic pressure sensors or accelerometers or other transducers (not shown) which permit the measurement of the ball's collision momentum, namely its velocity vector (from which the momentum may be computed, because the ball's mass is well known in advance). An attached electronic computer or equivalent network may be used to predict where the ball would have gone on the greens, under pre-specified assumed whether conditions and wind factors.

This feature for simulation of actual play may be enhanced by immediate visual and/or audio-visual display or synthetic-voice presentation of the predicted performance of the stroke. The techniques for recording, displaying, storing, and printing such information are well known in other sports simulation contexts, such as in automatic karate training systems, but in combination with the presently disclosed golf-training structures constitute a new combination of old elements which provides an unexpected and nonobvious result.

Figure 3:
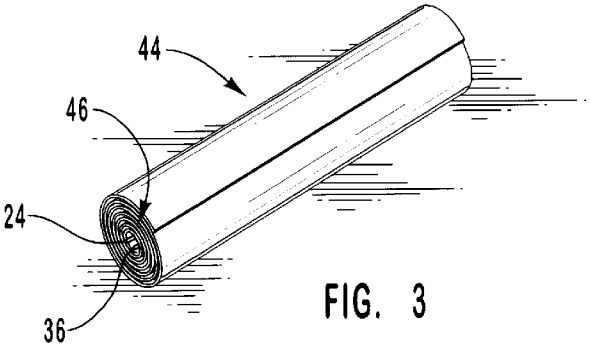
FIG. 3 is a perspective view of the disassembled, folded, rolled and packed personal sporting net shown in FIG. 1.

At the conclusion of the user's practice session, the entire assembly may be disassembled, folded, rolled and compactly packaged for easy portability. In the presently preferred embodiment, the cylindrical disassembled, folded, rolled and packed portable assembly 44 measures about two feet long and is less than six inches in diameter. In FIG. 3 an end of a tent pole 46 is depicted in order to show that the tent poles 24 and 36 are placed parallel to the axis of the cylindrical assembly 44.

It is to be understood that the foregoing detailed description, and the accompanying drawings illustrate one embodiment of the invention. Various changes may be made without departing from the spirit and the scope of the invention. Thus, by way of example and not of limitation, the cross-section of the funnel composed of the netting 34 need not be exactly circular but could be quadrangular, triangular, ovulate, or indeed of any shape so long as the funnel is topologically a cylinder.

Furthermore, personal sporting net 11 can be set up anywhere to be used during lunch hours, family outings, picnics, camping trips, by schools, etc. with unlimited potential. In addition, the parts need not have the precise configuration described hereinabove, but may have alternative arrangements.

Figure 4:
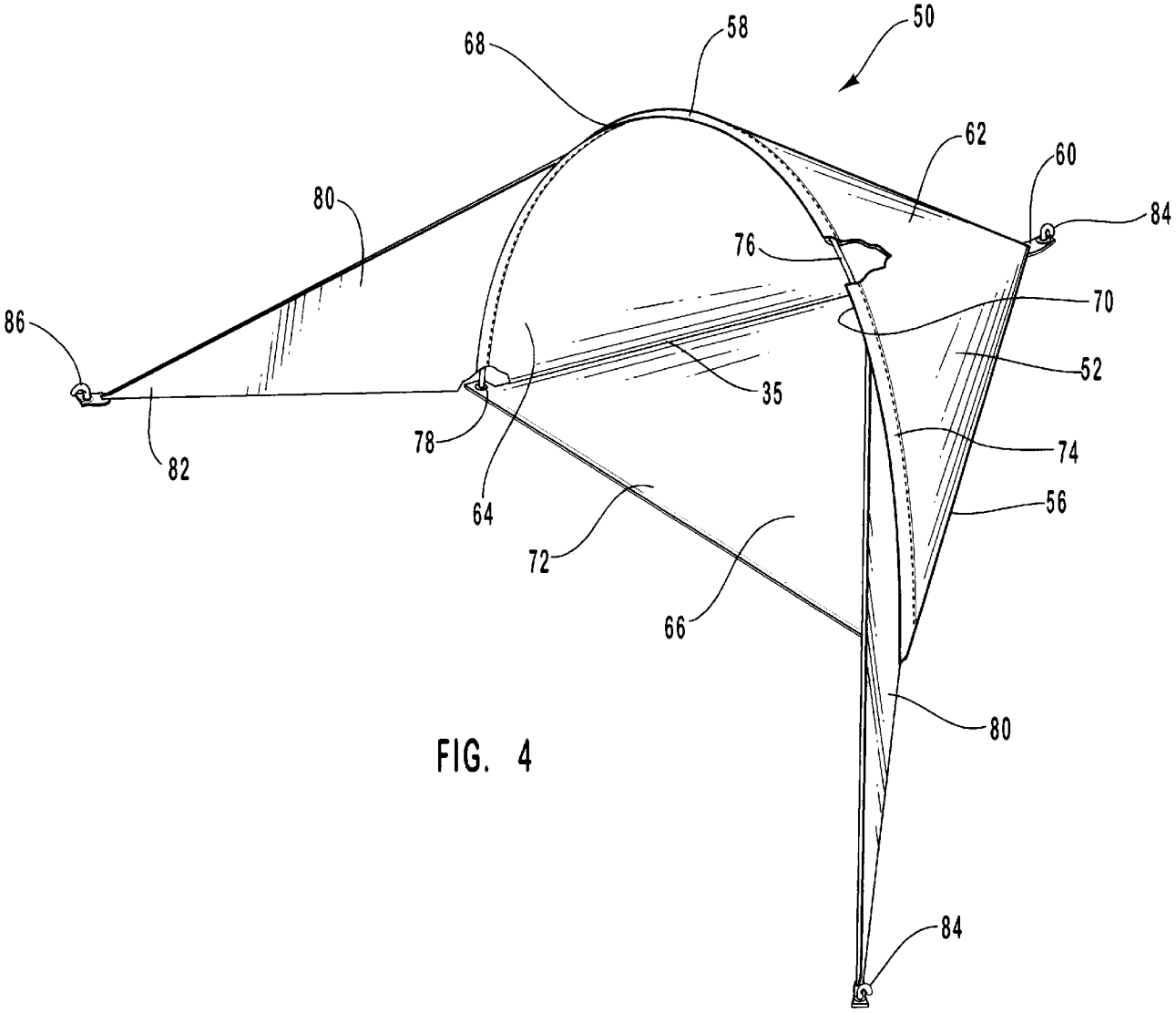
FIG. 4 is a perspective view of an alternative embodiment of the personal sporting net shown in FIG. 1.

As another alternative embodiment to personal sporting net 11, depicted in FIG. 4 is a personal sporting net 50. Personal sporting net 50 comprises a collapsible backstop 52 having opposing outside edges 54 and 56 that extend between a front end 58 and a back end 60. Backstop 52 further comprises an exterior surface 62 and an interior surface 64. In the embodiment shown, backstop 52 has a substantially semi-conical configuration. As a result, when backstop 52 is mounted on a ground surface, interior surface 64 defines a receiving chamber 66 having a substantially semiconical configuration. In alternative embodiments, backstop 52 can have any desired funnel or tapered configuration.

Positioned at first end 58 of backstop 52 is a semi-circular lip 68 that defines an access opening 70 to receiving chamber 66. In alternative embodiments, lip 68 can be any desired arch shaped configuration. Receiving chamber 66 radially constricts from access opening 70 so as to be closed against the ground surface at back end 60. In this way, balls that are hit into receiving chamber 66 are collected at back end 60.

In one embodiment, backstop 52 is made from collapsible netting. The netting allows personal sporting net 50 to be easily folded into a small area. Furthermore, porous netting allows wind to easily pass therethrough without substantially deflecting or carrying away personal sporting net 50. In alternative embodiments, backstop 52 can also be formed from materials such as cloth, nylon, canvas, or the like. In one embodiment, the material of backstop 52 is loosely hung when personal sporting net 50 is assembled. As a result, the material helps to absorb the energy of the ball rather than reflect the ball back at the user.

Connected to and extending between outside edges 54 and 56 of backstop 52 is a floor 72. Floor 72 prevents balls from escaping receiving chamber 66 by passing beneath opposing outside edges 54 and 56. Floor 72 also maintains backstop 52 in its desired semi-conical configuration.

In one embodiment of the present invention, means are also provided for selectively positioning access opening 60 into an upstanding position. By way of example and not by limitation, a sleeve 74 is secured around lip 68 of backstop 52. Selectively positioned within sleeve 74 is a pole 76. Positioned on floor 72 at opposing ends of sleeve 74 are apertures 78. Apertures 78 are configured to receive opposing ends of pole 76. Accordingly, by selectively bending pole 76 into an arcuate configuration within sleeve 74 and positioning opposing ends thereof within apertures 78, access opening 70 is positioned in an upstanding position.

As previously discussed with pole 24, pole 76 can be comprised of a plurality of collapsible units that are integrally held together or formed from distinct shorter poles that are connected together at opposing ends. In yet another embodiment, pole 76 can be a unitary arch-shaped member. Pole 76 can also be formed from a variety of materials such as aluminum, fiberglass, or plastic.

Positioned on opposing sides of access opening 70 is a pair of flaps 80. Each of flaps 80 are substantially triangular in configuration and radially extend outward and forward from front end 58 of backstop 52 to a free end 82. Flaps 80 help to funnel stray balls into receiving chamber 66. More specifically, flaps 80 are used for capturing and directing balls that are either sliced or hooked when struck by a golf club. Flaps 80 can be made of the same material as backstop 52.

To secure personal sporting net 50 to a ground surface, apertures 84 are formed at each free end 82 of flaps 80 and at back end 60 of backstop 52. Such apertures can be formed by the use of grommets or other conventional means. In turn, pegs 86 can be passed through apertures 84 for securing such locations to the ground surface.

Figure 5:
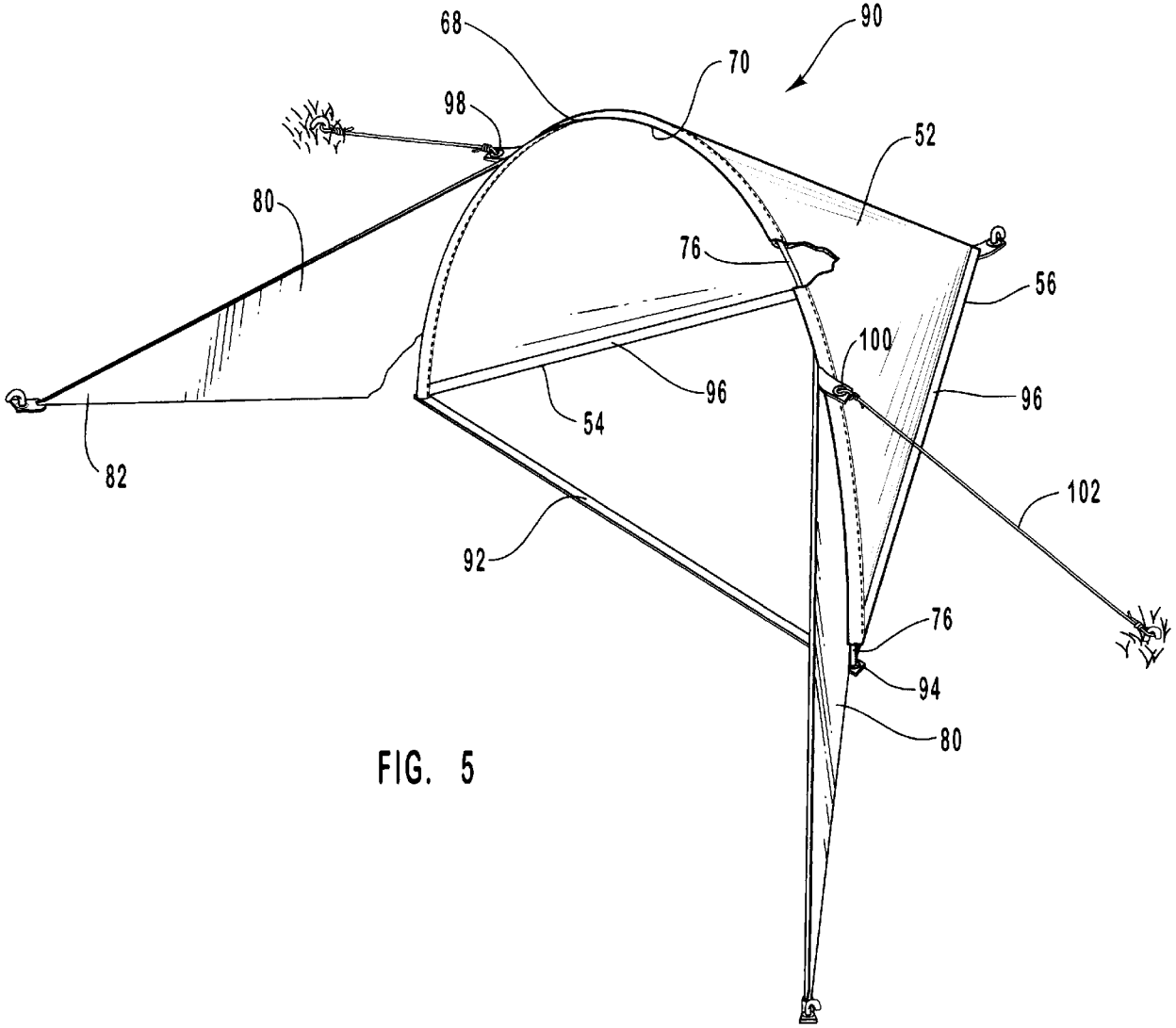
FIG. 5 is a perspective view of an alternative embodiment of the personal sporting net shown in FIG. 4.

Depicted in FIG. 5 is a personal sporting net 90 which is an alternative embodiment of personal sporting net 50 depicted in FIG. 4. The elements of personal sporting net 90 that are the same as those in sporting net 50 are identified by like reference characters. Personal sporting net 90 is distinguished from personal sporting net 50 in that it does not include floor 72. Rather, a connecting strap 92 having apertures 94 positioned on opposing ends thereof is positioned so as to extend between the opposing ends of lip 68 of backstop 52. Apertures 94 are configured to receive the opposing ends of pole 76, thereby maintaining pole 76 in its arcuate shape.

Personal sporting net 90 also includes reinforced hems 96 positioned along outside edges 54 and 56 of backstop 52. Reinforcing hems 96 help to prevent balls from traveling beneath outside edges 54 and 56. Furthermore, to further support access opening 70 in an upstanding position, connecting tabs 98 are mounted on lip 68 above each of flaps 80. Connecting tabs 98 each have an aperture 100 extending therethrough. Apertures 100 enable the attachment of a rope 102 or other similar structure which can subsequently be secured to the ground surface.

The resulting personal sporting net can be folded up into a small bag for easy transport. Furthermore, the personal sporting net can be easily and quickly assembled at any desired location for use. Furthermore, the personal sporting net can be used to practice golf, i.e, a personal driving range, as well as other sports such as football, baseball, or soccer.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A portable personal sporting net, comprising:

(a) a tapered cylindrical or conical-frustum or funnel-like tubular, pliable, porous net having a larger end and an opposing smaller end;

(b) a collapsible entrance aperture support structure, for holding the larger end of said tubular net open and facing a user;

(c) a collapsible exit aperture suspension structure, for stretching said net from said entrance structure and suspending the smaller end of said tubular net open and facing said user; and (d) a used ball capture bag, attached snugly to said smaller end of said tubular net, and depending pendulously therefrom, into which spent balls drop under the force of gravity after their forward momentum has been partially absorbed and partially diverted downward by striking the portion of said bag facing said tubular net's exit aperture.

2. A personal sporting net as recited in claim 1, further comprising a plurality of joinable tent poles, combinable to form an arch comprising said entrance aperture support structure.

3. A personal sporting net as recited in claim 1, further comprising a plurality of joinable tent poles, combinable to form an arch comprising said exit aperture support structure.

4. A personal sporting net as recited in claim 1, further comprising a pliable, slip-resistant user platform used for positioning of said user.

5. A personal sporting net as recited in claim 1, further comprising a sturdy, pliable, strike-absorbent ball mat for positioning of a tee and ball.

6. A personal sporting net as recited in claim 1, further comprising a resilient, solid exit-aperture blocking disk, adaptable for installation opposite the smaller end of said tubular net and within said bag, whereby the forward momentum of a driven ball may be absorbed and converted into heat for dissipation, thereby facilitating the diversion of said ball downwards under the force of gravity.

7. A personal sporting net as recited in claim 6, further comprising a plurality of momentum transducers attached to the side of said disk farthest from said net, whereby the momentum of a ball striking said disk may be monitored electronically.

8. A personal sporting net as recited in claim 7, further comprising an electronic computing system connected to said transducers, whereby a simulated prediction of the unimpeded further trajectory of said ball may be computed, taking into account pre-specified simulations of weather conditions and wind factors, for immediate presentation to said user of information whereby the effectiveness of the user's practice stroke may be gauged.

9. A personal sporting net as recited in claim 1, farther comprising a front aperture capture net, comprising a shallow barrier across the bottom of the larger opening of said tubular net, arrayed to prevent spent balls which have not passed through said smaller end of said tubular net from rolling back out of said larger opening.

10. A personal sporting net as recited in claim 1, further comprising a pair of bracing legs for holding said entrance aperture support structure in an upright or vertical position.

11. A personal sporting net as recited in claim 10, further comprising attachment means whereby said bracing legs may be temporarily fixed to the surface upon which said net is erected.

12. A personal sporting net as recited in claim 1, further comprising said tubular net having a length of between six feet and nine feet and an entrance aperture area between fifteen square feet and thirty five square feet.

13. A personal sporting net comprising:

(a) a collapsible backstop having a front end and an opposing back end, the backstop when positioned on a ground surface defining a receiving chamber having an enlarged arcuate access opening at the front end, the receiving chamber longitudinally constricting from the access opening and closed at the back end of the backstop;

(b) means for selectively positioning the access opening into an upstanding position, wherein the means for selectively positioning the access opening comprises a pole secured to the front end of the backstop;

(c) a pair of elongated flaps connected to opposing sides of the access opening, the flaps being configured to radially extend out and forward from the access opening; and (d) a connecting strap having apertures extending through the opposing ends thereof, the apertures being configured to receive and retain the opposing ends of the pole when the pole is bent into an arcuate configuration.

14. A personal sporting net as recited in claim 13, further comprising a floor attached to the backstop.

15. A personal sporting net as recited in claim 13, wherein the backstop is made of netting.

16. A personal sporting net as recited in claim 13, wherein the receiving chamber has a completely semi-conical configuration.

17. A personal sporting net as recited in claim 13, wherein the flaps have a substantially triangular configuration.

18. A personal sporting net comprising:

(a) a collapsible backstop having a substantially semi-conical configuration when positioned on a ground surface, the backstop defining a receiving chamber comprising an enlarged access opening positioned at a front end and being closed at an opposing back end;

(b) a flexible pole connected to the front end of the backstop;

(c) a connecting strap having apertures extending through the opposing ends thereof, the apertures being configured to receive and retain the opposing ends of the pole when the pole is bent into an arcuate configuration to position the access opening into an upstanding position; and (d) a pair of elongated flaps connected to opposing sides of the access opening, the flaps being configured to radially extend out and forward from the access opening.

19. A personal sporting net as recited in claim 18, wherein the backstop is made of netting.

20. A personal sporting net as recited in claim 18, wherein the backstop comprises an outside edge having a reinforcing hem positioned thereat.

* * * * *